US010267126B2

(12) United States Patent
Themig

(10) Patent No.: US 10,267,126 B2
(45) Date of Patent: Apr. 23, 2019

(54) WELLBORE LATERAL LINER PLACEMENT SYSTEM

(71) Applicant: PACKERS PLUS ENERGY SERVICES INC., Calgary (CA)

(72) Inventor: Daniel Jon Themig, Calgary (CA)

( * ) Notice: Subject to any disclaimer, the term of this patent is extended or adjusted under 35 U.S.C. 154(b) by 0 days.

(21) Appl. No.: 15/492,990

(22) Filed: Apr. 20, 2017

(65) Prior Publication Data

US 2017/0218726 A1 Aug. 3, 2017

Related U.S. Application Data

(62) Division of application No. 13/812,591, filed as application No. PCT/CA2011/000869 on Jul. 28, 2011, now Pat. No. 9,644,459.

(60) Provisional application No. 61/368,527, filed on Jul. 28, 2010.

(51) Int. Cl.

| | |
|---|---|
| ***E21B 43/10*** | (2006.01) |
| ***E21B 41/00*** | (2006.01) |
| ***E21B 33/129*** | (2006.01) |

(52) U.S. Cl.

CPC ..... *E21B 43/10* (2013.01); *E21B 33/129* (2013.01); *E21B 41/0035* (2013.01)

(58) Field of Classification Search

CPC ..... E21B 34/12; E21B 43/045; E21B 43/08; E21B 43/16

See application file for complete search history.

(56) References Cited

U.S. PATENT DOCUMENTS

| | | | |
|---|---|---|---|
| 2,397,070 | A | 3/1946 | Zublin |
| 5,388,648 | A | 2/1995 | Jordan, Jr. |
| 5,415,238 | A | 5/1995 | Nice |
| 5,458,209 | A | 10/1995 | Hayes et al. |
| 5,477,925 | A | 12/1995 | Trahan et al. |
| 5,954,134 | A | 9/1999 | Longbottom |
| 6,012,526 | A | 1/2000 | Jennings et al. |
| 6,279,659 | B1 | 8/2001 | Brunet |
| 6,419,026 | B1 | 7/2002 | MacKenzie et al. |
| 6,561,279 | B2 | 5/2003 | MacKenzie et al. |
| 6,752,211 | B2 | 6/2004 | Dewey et al. |
| 6,848,504 | B2 | 2/2005 | Brunet et al. |
| 7,011,151 | B2 | 3/2006 | McGarian et al. |
| 7,104,332 | B2 | 9/2006 | Murray et al. |
| 7,117,949 | B2 | 10/2006 | Doane et al. |

(Continued)

FOREIGN PATENT DOCUMENTS

| | | |
|---|---|---|
| CA | 2369473 A1 | 7/2002 |
| CN | 202970513 | 6/2013 |

(Continued)

*Primary Examiner* — Caroline N Butcher

(57) ABSTRACT

A system for placement of a liner in a lateral wellbore, access to which is provided through a window having a V-shaped downhole end. The system includes a running tool including an upper end through which the running tool is manipulated from surface, a lower end, a key positioned between the upper end and the lower end, the key protruding from the running tool for locating the V-shaped downhole end of the window and a liner-engaging portion on the downhole end for releasably securing the wellbore liner to the running tool, the liner-engaging portion configured to secure the liner adjacent the key with the key protruding above the liner and the liner extending from the lower end. The invention also provides methods for placing a wellbore liner in a lateral wellbore extending from a main wellbore.

19 Claims, 5 Drawing Sheets

(56) References Cited

U.S. PATENT DOCUMENTS

| | | | |
|---|---|---|---|
| 7,231,980 | B2 | 6/2007 | Murray et al. |
| 7,373,984 | B2 | 5/2008 | Pratt et al. |
| 9,291,003 | B2 | 3/2016 | Sponchia et al. |
| 2003/0150612 | A1 | 8/2003 | McGarian et al. |
| 2004/0159435 | A1 | 8/2004 | Plucheck et al. |
| 2010/0059279 | A1 | 3/2010 | Saylor |
| 2013/0126165 | A1 | 5/2013 | Themig |
| 2013/0284460 | A1 | 10/2013 | Hallundbaek |
| 2015/0047853 | A1 | 2/2015 | Hurtado |

FOREIGN PATENT DOCUMENTS

| | | |
|---|---|---|
| RU | 2381351 C1 | 2/2010 |
| WO | WO 00/31375 | 6/2000 |

WELLBORE LATERAL LINER PLACEMENT SYSTEM

CROSS-REFERENCE TO RELATED APPLICATIONS

This application is a Division of U.S. application Ser. No. 13/812,591, filed Jan. 28, 2013, which is a national stage application of International Application No. PCT/CA11/00869, filed Jul. 28, 2011, and claims priority from U.S. Provisional Application No. 61/368,527, filed Jul. 28, 2010, all of which are fully incorporated herein by reference.

FIELD OF THE INVENTION

The invention relates to wellbore tools and operations including, particularly, a system and a method for placing a wellbore liner in a lateral wellbore.

BACKGROUND OF THE INVENTION

Lateral wellbores extend from a main wellbore. Multilateral wells may have a number of lateral wellbores extending from immediately adjacent main wellbores. A lateral wellbore forms a juncture with the main wellbore from which it extends. Generally, lateral wellbores are accessed through a window removed from the main wellbore wall. Sometimes the window opening is preformed in the casing and the lateral is drilled therethrough and extends therefrom and sometimes the window is formed entirely by drilling out from the main wellbore through the casing and cement, if any, through the borehole wall and outward therefrom. As shown in FIG. 1, a lateral 10 extends at an acute angle from a main wellbore 12. Since wellbores are generally formed to have circular cross sections, the window 14 often is elliptical or tear-drop, as shown, in shape having a substantially V-shaped downhole end 14*a* and a more rounded upper limit 14*b* at the upper end 16 of the lateral wellbore.

While the main wellbore is shown cased with casing 15 and including annular cement 17, the wellbore could be open hole without a lining of casing or cement. In such a case, the window would be the transition from the main wellbore wall to the wall of the lateral wellbore.

If it is desired to line the lateral wellbore with a liner, it is sometimes difficult to accurately position the liner relative to the window and, therefore, often the uphole end of the liner is positioned at a distance from the window along the lateral wellbore. This leaves an open hole region of the wellbore between the window and the liner. This open hole region can degenerate and possibly even cave in, especially when wellbore operations begin. Some solutions connect a flange to the upper end of the liner such that the flange can be fitted against the window in the main wellbore to position the liner. However, the flange remains protruded into the main wellbore and may adversely affect access therepast.

SUMMARY OF THE INVENTION

A system has been invented for placement of a liner in a lateral wellbore, access to which is provided through a window having a V-shaped downhole end. The system includes a running tool including an upper end through which the running tool is manipulated from surface, a lower end, a key positioned between the upper end and the lower end, the key protruding from the running tool for locating the V-shaped downhole end of the window and a liner-engaging portion on the downhole end for releasably securing the wellbore liner to the running tool, the liner-engaging portion configured to secure the liner adjacent the key with the key protruding above the liner and the liner extending from the lower end.

The invention also provides a method for placing a wellbore liner in a lateral wellbore extending from a main wellbore, the method including (i) supporting a liner on a running tool, the running tool having an uphole end through which the running tool is manipulated from surface and a key protruding from the uphole end for locating a V-shaped downhole end of a window beyond which the lateral wellbore extends, (ii) manipulating the running tool to run the liner into a lateral wellbore, (iii) employing the running tool key to locate a V-shaped downhole end of a window leading to the lateral wellbore and to drive the running tool to be rotated to place the liner in the lateral wellbore, (iv) releasing the liner from the running tool, and (v) withdrawing the running tool including the key from the wellbore.

A further method is provided for placing a wellbore liner in a lateral wellbore extending from a main wellbore, the method including (i) supporting a liner on a running tool, the running tool having an uphole end through which the running tool is manipulated from surface and a key protruding from the uphole end for locating a V-shaped downhole end of a window beyond which the lateral wellbore extends, (ii) manipulating the running tool to run the liner into a lateral wellbore, (iii) employing the running tool key to locate a V-shaped downhole end of a window leading to the lateral wellbore; (iv) setting an installation structure to secure the liner in the lateral wellbore with no portion of the liner and no portion of the installation structure protruding into the main wellbore; (v) releasing the liner from the running tool; and (vi) withdrawing the running tool including the key from the wellbore.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 2:
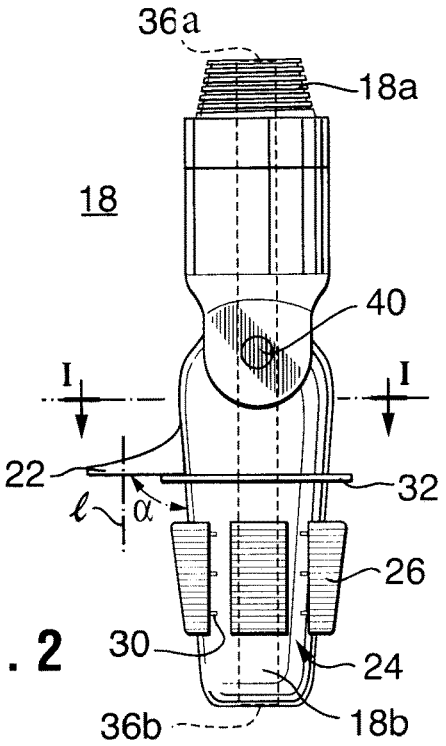
FIG. 2 is a schematic illustration of a liner running tool.
Figure 3:
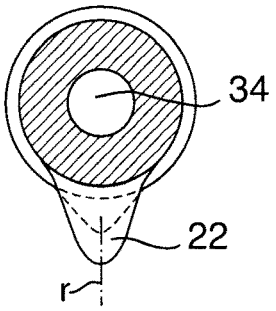
FIG. 3 is a schematic illustration of the liner running tool of FIG. 2, sectioned along line I-I.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts. It is noted, for example, that the running tool of FIG. 4 differs from that of FIG. 2 in some ways although some identical numbering is used in the two figures.

Figure 1:
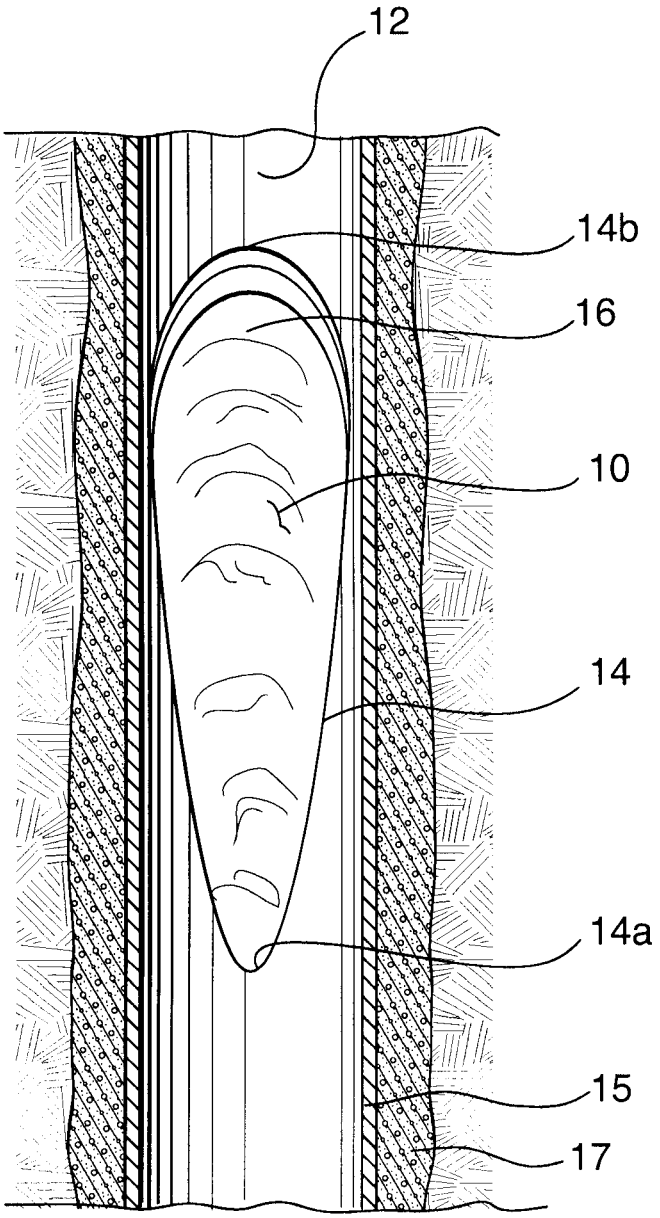
FIG. 1 is a schematic illustration of a section through a well showing a wellbore junction of a main wellbore and a lateral wellbore.
Figure 4:
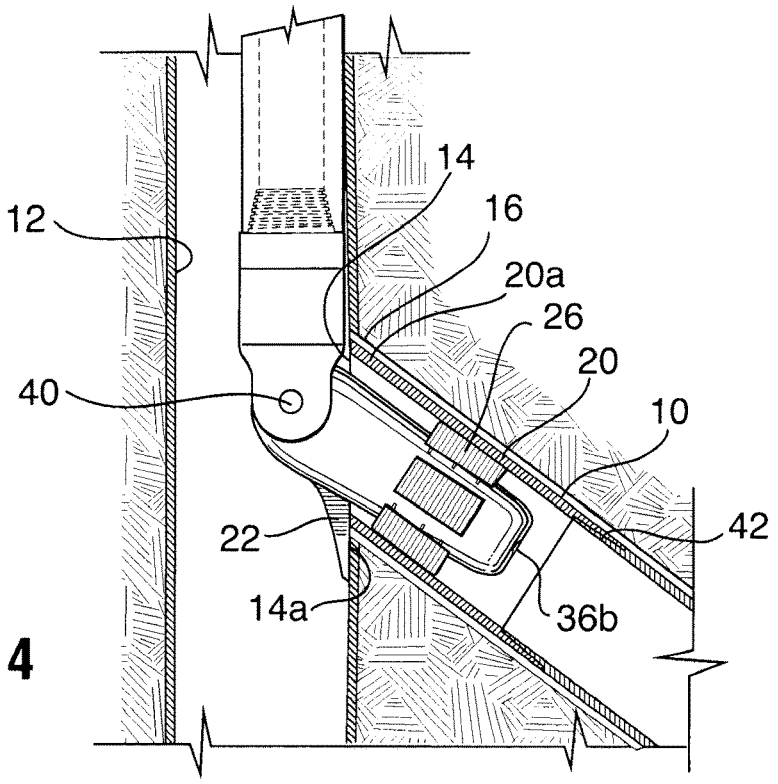
FIG. 4 is a schematic illustration of a liner running tool in operation placing a liner at a wellbore juncture.

With reference to the drawings, a lateral wellbore 10 extends from a main wellbore 12 at a juncture, which is generally that area illustrated in FIGS. 1 and 4. A lateral wellbore is accessed through a window 14 removed from the main wellbore wall and in this case is an opening formed by milling through the casing 15 and allows access to the lateral, which extends beyond the window at an acute angle from the main wellbore. Since wellbores are generally formed to have circular cross sections, the window often is elliptical or tear-drop in shape defined by an upper limit 14*b* where the upper edge 16 of the lateral wellbore first extends away from the main wellbore. The elliptical shape of window 14 forms a substantially V-shaped downhole end 14*a*.

A running tool 18 is provided for placing a wellbore liner 20 in the lateral wellbore with the upper end 20*a* of the liner directly adjacent the window but avoiding the placement of a portion of the liner extending out into the main wellbore.

The running tool may include an uphole end 18*a* through which the running tool is manipulated from surface, a downhole end 18*b*, a key 22 for locating the V-shaped downhole end of the window leading to the lateral wellbore and a liner-engaging portion 24 for engaging a wellbore liner, the liner-engaging portion configured to releasably secure the liner upper end 20*a* of the liner adjacent the key and opposite (on the other side of the key from) the uphole end.

Uphole end 18*a* can be formed in various ways for connection to and manipulation from surface. For example, the uphole end can be connected by forming integral with, or threaded, shaped or otherwise configured for connection to, a wellbore work string such as a string of tubulars, a string of rods or coiled tubing.

The liner-engaging portion may take various forms, but at least releasably engages the liner. The liner-engaging portion is formed to engage the liner such that the liner can be manipulated to some degree by the running tool and can be actuated to disengage from the liner such that the running tool can be released from engagement with the liner. The running tool, for example, through the liner-engaging portion, may any or all of: push, support the weight of, axially turn, etc., the liner. The liner-engaging portion is positioned on downhole end 18*b* and engages the liner such that the liner is secured on the downhole end and extends off the downhole end away from the uphole end. In one embodiment, no liner engaging members are on the uphole end such that all engagement to the liner is through the downhole end, below the key.

The liner-engaging portion may include a gripper 26 to releasably engage the wall of the liner adjacent its uphole end. In one embodiment, for example, the gripper 26 encircles and is exposed on the tool body. The gripper is positionable to engage a wall of the liner adjacent its uphole end and is releasable to disengage from the liner. The gripper can include shear pins, one or more of an expandable member formed of metal, such as one or more slips, expansion rings, etc., or formed of an elastomer such as an inflatable or extrudable member, etc. In one embodiment, the gripper is an expandable member that can be expanded to engage an outer or more usually an inner wall surface of the liner adjacent its uphole end and retractable to disengage from the liner. A mechanism 30 may be provided to drive such a gripper into and out of an engaging position relative to the liner.

Key 22 is positioned on the body between liner-engaging portion 24 and uphole end 18*a*. Key 22 is positioned and formed such that when a liner is engaged on the liner-engaging portion, the key is exposed above the liner for operation to locate the window. Key 22 further is secured to the liner-engaging portion such that rotation of the body at the position of the key is communicated directly to the liner-engaging portion such that any rotation of the tool at the key results in identical rotation of the liner-engaging portion. The key is used to ensure proper placement of the liner in the lateral wellbore. The key extends out from the running tool body, effectively increasing the diameter of the running tool at the location of the key such that the tool at the key cannot fit into the lateral wellbore. Key 22, extending from the running tool body, can be used to locate the window, since it is oversized and cannot easily be advanced through the window. For example, as the tool moves through the window into the lateral wellbore, key 22 may catch on the window's edge and prevent the tool from being advanced further through the window and may prevent the tool from being rotated in a direction that moves the key against the edge of the window. The running tool, for example, may be run in and located about at the location of the window with the liner extending through the window. The key will at least then be extended. The running tool may then be moved axially and/or rotationally in the well until the string condition indicates that the key has been is caught on an edge of the window. For example, if upon moving the string, resistance is sensed in further advancement of the string, it can be determined that the key is caught on an edge of the window such that further movement of the string in that direction is resisted.

Key 22 may protrude permanently from the running tool body, may be biased to normally protrude from the running tool but is collapsible if sufficient force is applied to overcome the biasing force or may be normally retracted and releasable, when desired, to an extended position (biased or not) when it is desired that the key assume that position. An expandable key may be driven by a mechanism that holds the key in an inactive position, for example substantially retracted, and then releases it to assume an active position. The mechanism may operate by electrical, hydraulics, biasing and/or mechanical means and may be actuated by electrical, signaling, hydraulic pressure, sensitivity to wellbore conditions (hydrostatic pressure) or by a timer.

The key, for example, may be formed to locate the window and specifically the downhole V-shaped end of a lateral window. The shape and form of the lower end of a lateral window formed by drilling such as a milling downhole is generally known and the key can be formed accordingly. If the window is formed at surface, the shape of the downhole end can be more particularly known and the key can be formed accordingly. The key 22 may be formed to locate the window as by selection of one or more of: (i) the angle α at which it extends from the running tool body, (ii) the side to side and base to tip cross sectional shape (see line r), (iii) the longitudinal (top to bottom) cross sectional shape (see line 1), etc. Selection of one or more of these factors can allow key 22 to positively land on and become releasably retained on the downhole V-shaped end of the window. For example, the key may extend from the running tool and have a downhole overhanging end, which in particular extends at an acute angle from the tool body. Alternately or in addition, the downhole end of the key may have a substantially V-shape in longitudinal section, wherein the side walls to some degree taper toward the lower end of the key.

Alternately or in addition, key 22 may be selected to have a low friction interaction with the window. For example, it may have smooth curved sides without sharp angles so that the key can travel more easily along the edges of the window such that the key, and therefore the running tool, can move down along the window after the key catches on the edge.

Key 22 may be the only locating device, the sole on the running tool for orienting the tool relative to the window. No other keyways or mule shoes are needed in the main wellbore or on the running tool, as the key locates the window and can drive rotation of the tool to locate and become located at the downhole end of the window.

As noted above, the key is positioned above the liner-engaging portion and is exposed even when a liner is engaged on the liner-engaging portion of the running tool so that the key remains available to guide the liner into position relative to the window. The key can act as a reference point for installation of the liner onto the running tool. In particular, the key can protrude and act as a stop against which the liner can be stopped when installing the liner on the running tool. Alternately the running tool may include a liner position indicator to facilitate placement, axially and/or rotationally, of the liner on the tool. In one embodiment, the indicator includes a stop flange 32 extending out against which the liner end 20*a* may be butted when the liner is engaged on the running tool. The stop flange 32 may serve to facilitate location of the liner, axially and/or rotationally, on the liner-engaging portion and may provide a force applying surface through which the running tool can apply force, such as a pushing force to any liner secured thereon. The stop flange may extend orthogonal to the mandrel long axis. In another embodiment, the stop flange may extend in an elliptical path about the mandrel to accommodate a wedge-like form of the liner upper end.

The running tool body may include an inner bore 34 extending from an opening 36*a* on the uphole end to permit communication, such as fluid communication, to the liner-engaging portion for actuation thereof. In one embodiment, the inner bore extends fully through the running tool body between an opening at the uphole end and an opening 36*b* adjacent the liner-engaging portion to permit fluids and/or tools to be communicated through the running tool into the inner bore of any liner secured thereon, such as may be useful for actuation of liner components, such as the liner's hanger, ports and/or packers.

The running tool body or the liner may have an articulated portion to permit the running tool to more easily bend around the angle defined at the juncture. Alternately or in addition, the tool or the liner may be provided with a swivel to permit the tool to swivel to locate key 22 in the appropriate place, such as the downhole V-shaped end of the window. In the illustrated embodiment, an articulating joint 40 is provided on tool 18 and a swivel 42 is provided in liner below its point of connection to the liner-engaging portion. If greater tool control is required, for example, to more controllably manipulate the liner, articulated joint 40 and/or swivel 42 may be eliminated or may be made to be operable only at selected times, such as when the tool is properly positioned downhole.

Liner 20 may be selected to operate with the running tool and to be selectively positionable in the well. As noted above, the liner may have a wedge-shaped upper end. For example, the upper end 20*a* of the liner may be formed to follow the shape of the window of the lateral wellbore in which it is to be positioned. The liner upper end may be cut at an angle across its long axis such that it has a tapering end. The angle may correspond to the angle at which the lateral kicks off from the main wellbore. In another embodiment, the end may be concavely shaped from side to side to follow the curvature of the main wellbore. The upper end to be wedge shaped tapering toward an end, which will be the upper end, and possibly concavely shaped from side to side.

The liner may also or alternately include swivel 42, as noted above.

Liner 20 may further include an installation structure operable to secure the liner in the lateral wellbore. The installation structure is positioned along the length of the liner such that it doesn't extend beyond the upper end of the liner, such that the liner and all of its components can be positioned entirely within the lateral wellbore without protruding into the main wellbore. In one embodiment, the liner carries a liner hanger at, or spaced from, the liner upper end. The liner may carry an annular packer for sealing the annulus about the liner, which will be that area between the liner and the lateral wellbore wall. The liner may carry anchoring slips for securing the liner in the lateral wellbore. The packer and the slips may act as a liner hanger.

In use, the tool may be employed in a method for placing a wellbore liner including (i) supporting a liner on the running tool, (ii) manipulating the running tool to run the liner into a lateral wellbore, (iii) employing the running tool key to locate the lower V-shaped end of the window, (iv) releasing the liner from the running tool, and (v) withdrawing the running tool including the key from the wellbore, leaving the liner in place in the wellbore liner.

In one embodiment, the upper end of the liner may be formed to follow the shape of the window to the lateral wellbore in which it is to be positioned. The liner upper end may be cut at an angle across its long axis such that it has a tapering end. The angle may correspond to the angle at which the lateral kicks off from the main wellbore. In another embodiment, the end may be concavely shaped from side to side to follow the curvature of the main wellbore. Such forming may shape the upper end to be wedge shaped tapering toward an end, which will be the upper end, and possibly concavely shaped from side to side.

Employing the running tool key to locate the lower V-shaped end of the window acts to ensure that running tool is properly oriented in the lateral wellbore, which in turn ensures that the liner upper end is properly oriented in the junction, for example, with the liner's tapered end positioned in the uphole end of the lateral and the liner and all components thereof positioned entirely in the lateral wellbore without any component of the liner or its installation structures protruding into the main wellbore. In one embodiment, employing the running tool key includes moving the running tool axially and/or rotationally to catch the key against the window to identify the location of the window. Employing the running tool key may also or alternately include moving the running tool while the key is caught against the window to allow the key ride down along the side of the window toward the lower V-shaped end of the window, which orients the running tool by lowering and/or rotating it. In another embodiment, employing the running tool key includes butting the key against the window such that the running tool cannot be further advanced into the lateral wellbore. Employing may include monitoring resistance to movement in the string, such as by monitoring string weight and/or torque, to determine when the key is caught against an edge of the window.

In one embodiment, employing is initiated only after the tool is run in to a selected position in the well. For example, employing the key may only be initiated when the running tool is determined to be close to the depth of the window, as may be determined by the length of the work string, as by drill pipe tally. Employing may include expanding the key from a retracted position. In one embodiment, for example, manipulating the running tool may include retaining the key in an inactive position, such as partially or fully retracted.

In another embodiment, employing the running tool key includes allowing the upper end of the liner to rotate relative to a lower portion of the liner about the liner's long axis to position the upper end of the liner properly in the upper portion of the lateral wellbore adjacent the window.

The placement of the liner will be adjacent the window but without any liner portion protruding from the lateral into the main wellbore. The liner upper end may be spaced less than 10 m and possibly less than 5 m away from the window. In one embodiment, the upper end of the liner will be positioned within one meter of the window, and possibly substantially flush with, or stated another way the upper limit of the lateral liner may be substantially in plane with, the main wellbore inner wall through which the window has been formed. In this position, the lateral wellbore is substantially entirely lined with the lateral liner including at its angled end such that problematic cave-ins are substantially avoided at the junction.

Withdrawing the running tool may include releasing the liner-engaging portion from engagement with the liner. In another embodiment, before releasing the liner from the running tool, liner components may be actuated. For example, in one embodiment, an installation structure, such as a liner hanger, may be set to secure the liner in the wellbore. An annular packer may be set to seal the annulus between the liner and the wellbore wall such that a seal is placed to prevent annular migration of fluids. Slips may be set to anchor the liner against the wellbore wall. The packer and slips may be a part of or independent from the liner hanger. Actuating liner components may include communicating from surface to the liner components, such as, for example, communicating a pressurized fluid to the liner components to actuate them hydraulically. Communicating a pressurized fluid may include passing fluid through the running tool body. Actuating components may include passing an actuating device, such as an actuating ball, through the running tool to actuate components therebelow.

After withdrawing, the liner remains in the lateral wellbore with an open annulus about the liner and the lateral wellbore wall. Where one or more packers have been set, cementing is unnecessary. As such in one embodiment, the method may include withdrawing while leaving the annulus open adjacent the upper end of the lateral wellbore and may avoid the insertion of the cement into the lateral wellbore.

Figure 5:
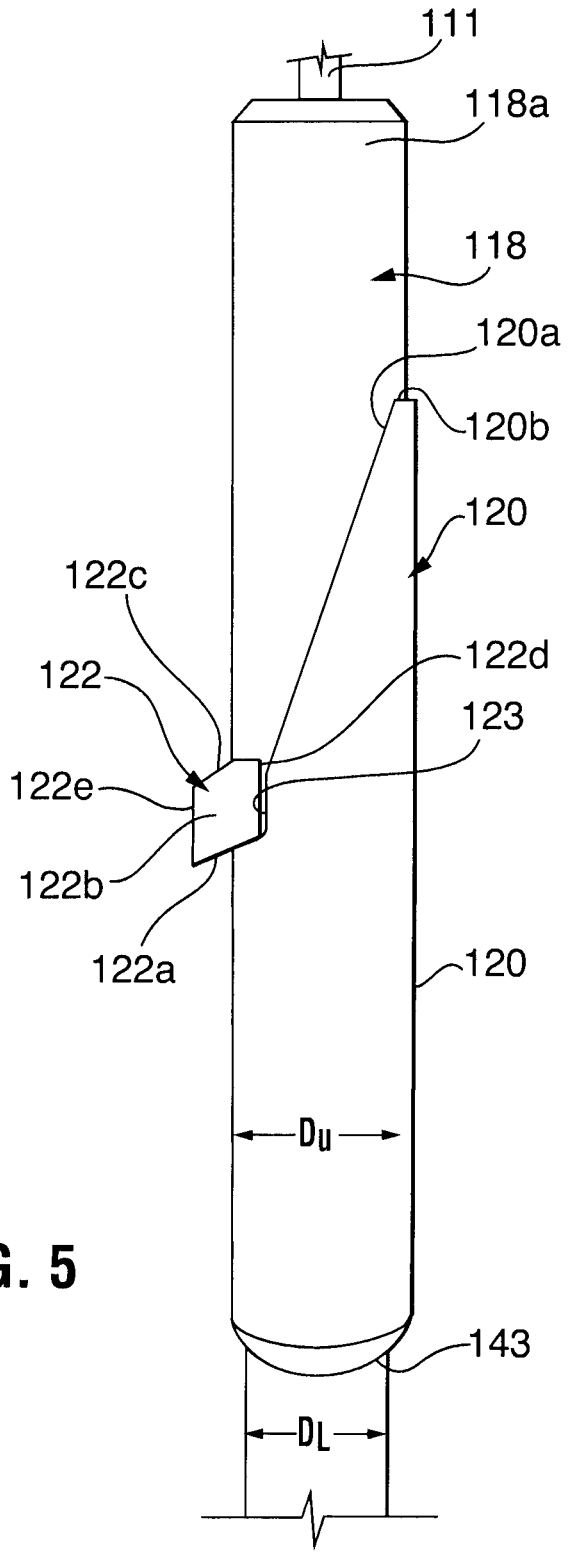
FIG. 5 is a schematic illustration of a liner running tool carrying a liner.
Figure 6A:
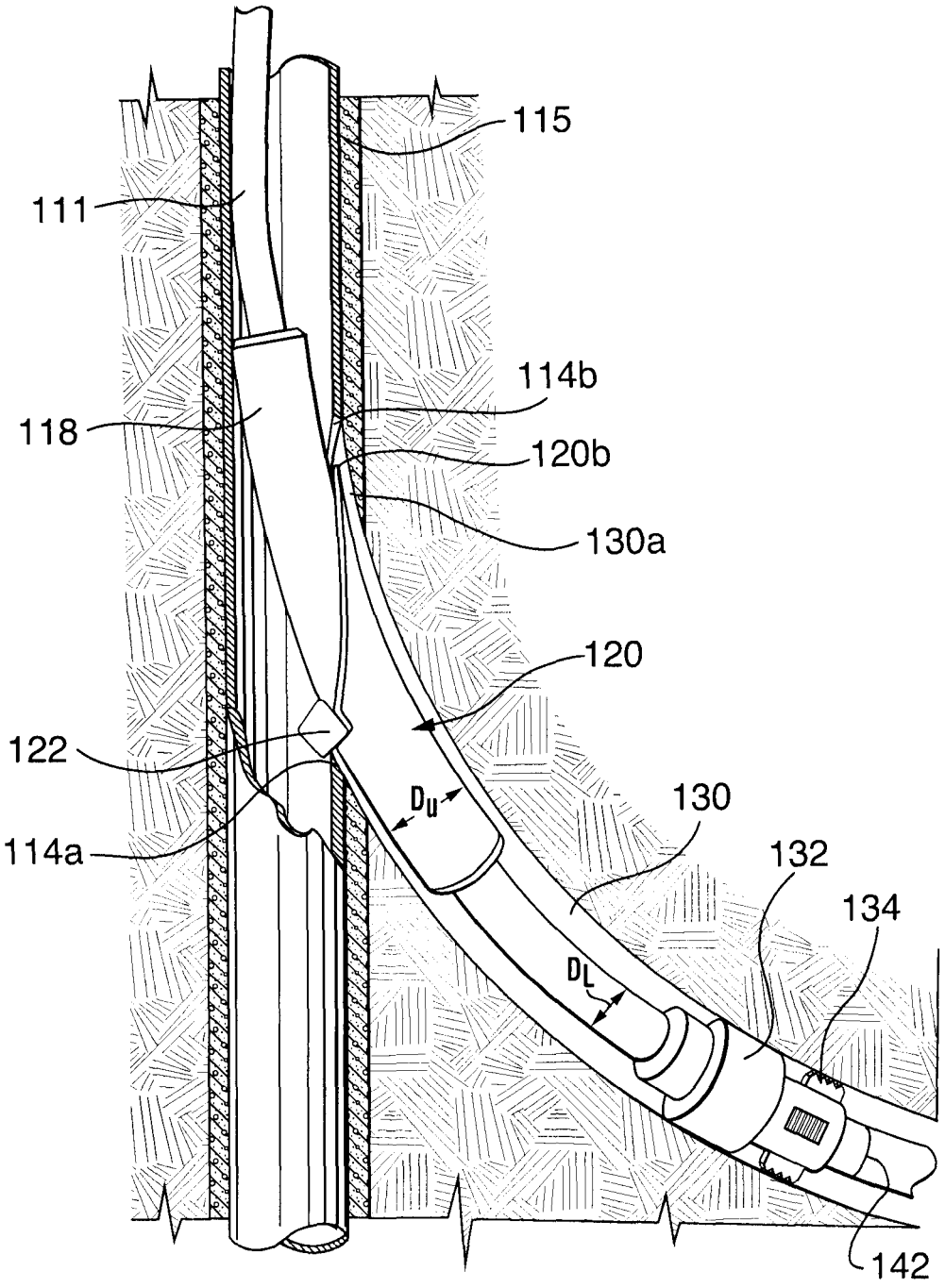
FIG. 6*a* is a schematic illustration of the liner running tool FIG. 5 installing a liner in a lateral wellbore.

With reference to the FIGS. 5 and 6, another running tool 118 is shown for placing a wellbore liner 120 in a lateral wellbore 110 with the upper end 120*a* of the liner directly adjacent a window 114 leading to the lateral wellbore but avoiding the placement of any portion of the liner extending out into the main wellbore.

The running tool may include an uphole end 118*a* to which the running tool is connected to a work string 111 such that it can be manipulated from surface, a key 122 for locating the V-shaped downhole end of the window leading to the lateral wellbore and a liner-engaging portion below the key, here shown covered by the liner, for engaging the liner.

Tool 118 is intended to operate with a liner having upper end 120*a* that is wedge-shaped. In particular, the liner's upper end has an upper edge that extends at an angle relative to its long axis such that it tapers to an upper tip 120*b*. Liner 120 further includes an installation structure operable to secure the liner in the lateral wellbore. The installation structure is positioned along the length of the liner, spaced from end 120*a* and when set is positioned entirely within the limits of the lateral wellbore and does not protrude into the main wellbore. The installation structure in this embodiment includes an open hole annular packer 132 for sealing an annulus 130 between the liner and the lateral wellbore wall and anchoring slips 134 for securing the liner in the lateral wellbore. The packer and slips act against the open hole wall of the lateral liner. Packer 132 and slips 134 may be settable in various ways such as by hydraulic, hydrostatic or mechanical. Although not shown, the liner may carry other components such as further packers, valves, etc.

Because the liner is set in the lateral borehole by packer 132 and slips 134, no cementing means, for example, none of a cement bypass, a cement valve, a stage tool, a float valve, etc. need be carried by the liner. As such the liner can be provided without annular cementing means.

The liner-engaging portion releasably engages the liner with enough force to permit the liner to be carried on, lifted, pushed and axially rotated, by the running tool. The liner-engaging portion is positioned on the downhole end of the body of the running tool and engages the liner such that the liner is secured on the downhole end and extends away from the uphole end.

Key 122 is positioned on the body such that when liner 120 is engaged on the liner-engaging portion, key 122 is exposed above the liner for operation to locate the window, and key 122 is secured to the liner-engaging portion such that rotation of the body at the position of the key is communicated directly to the liner-engaging portion such that any rotation of the tool at the key results in identical rotation of the liner-engaging portion, to ensure proper placement of the liner in the lateral wellbore. The key extends out from the running tool body, effectively increasing the diameter of the running tool at the location of the key, to a diameter greater than the diameter of the lateral wellbore in which it is to be run. Key 122, in this illustrated embodiment, is biased to protrude out from the running tool body. Key 122 can be collapsed by application of force thereto to reduce its protruded length but is biased to pop out to its fully extended length, when it is free of a constraining force. Key 122 therefore can be forced inwardly to allow the running tool to move through casing 115 in the main wellbore but will pop out when it is moved into an open area adjacent the window 114, such as when it rounds the corner from the main wellbore to the lateral wellbore. As such key 122 can be used to locate the window, since it has a diameter greater than the lateral wellbore and may catch on the window's edge if an attempt is made to move the key through the window.

Key 122 has a downhole overhanging end 122*a* that extends to define an acute angle between it and the tool body outer surface. Key also has side walls 122*b* (only one can be seen) that come together such that the width of the key tapers toward lower end 122*a*. The side walls are also generally smooth from top 122*c* to bottom 122*a* such that they have a low friction interaction with the wellbore wall about the window edges. The side walls from base 122d to outboard end 122e, extend at an angle, such as a right angle that permits them to catch on the edges of the window. In one embodiment, obtuse angling between these parts is avoided as this may create a ramp-like surface permitting the key to pass through the window.

As noted above, the key is positioned above the liner-engaging portion and is exposed even when liner 120 is engaged on the liner-engaging portion of the running tool so that the key remains available to guide the liner into position relative to the window. The key can act as a reference point for installation of the liner onto the running tool. In particular, in this embodiment, key 122 protrudes and acts as a stop against which the liner is stopped when installing the liner on the running tool. The liner includes a positioning notch 123 shaped to accommodate the shape of the key such that liner 120 can be readily and properly positioned on the running tool. Notch 123 is positioned on the liner at the portion of the liner which is to be positioned at the V-shaped bottom end 114*a* of the window and ensures that the tapering tip 120*b* of the liner is positioned on the running tool opposite the key such that tip 120*b* becomes positioned adjacent the upper region 114*b* of the window.

The running tool body may include an inner bore extending from its uphole end 118*a* to its lower end to permit fluid communication therethrough.

The liner in this embodiment, includes a swivel 142, which allows the liner thereabove to swivel relative to the liner below. This allows the tool, key and liner portion above swivel 142 to be rotated from surface or as driven by the interaction of the key against the window, while the lower portion of the liner, below swivel 142, to be unaffected. The upper end of liner 120 also has a diameter $D_U$ larger than the diameter DL across the major portion of the liner, for example, that portion of the liner below the angled upper end and/or which carries the packer 132. In this embodiment, diameter $D_U$ is reduced to diameter $D_U$ at step 143. For example, in one embodiment the upper end 120*a* is selected to have a diameter just slightly less than the diameter of the lateral wellbore such that the upper end substantially extends fully across the lateral wellbore diameter such that the annular space 130*a* at the upper end is minimized to thereby minimize the risk of tools being hung up on the liner upper end when tools are moved from the main wellbore into the lateral wellbore. Upper end 120*a* might be free (unanchored directly) and have an open annulus 130*a* thereabout, as shown.

Figure 6B:
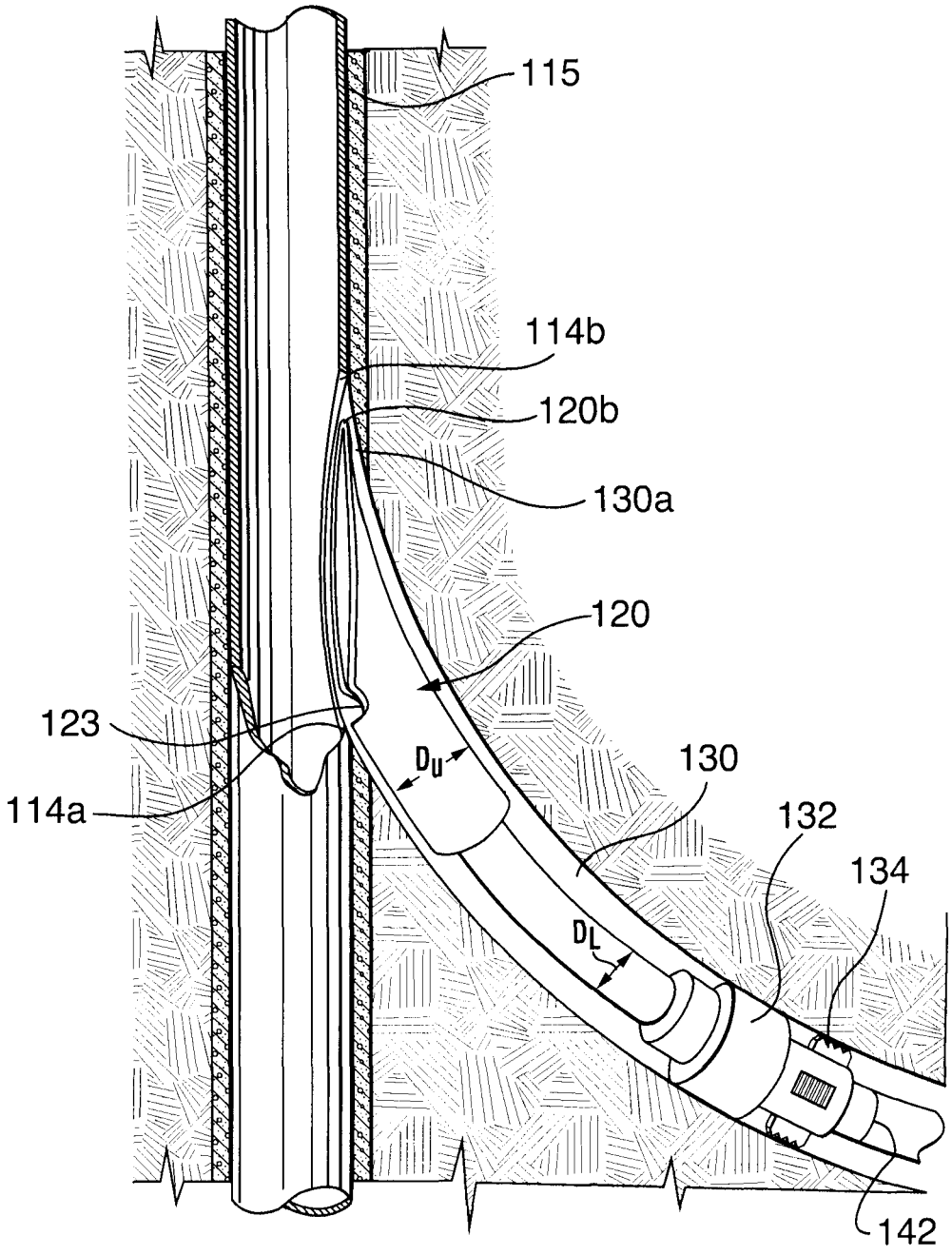
FIG. 6*b* is a schematic illustration of the liner of FIG. 6*a* installed in a lateral wellbore.

In use, tool 118 may be employed in a method for placing a wellbore liner including (i) supporting a liner on the running tool (FIG. 5), (ii) manipulating the running tool to run the liner into a lateral wellbore, (iii) employing the running tool key to locate the lower V-shaped end of the window (FIG. 6*a*), (iv) releasing the liner from the running tool, and (v) withdrawing the running tool including the key from the wellbore, leaving the liner in place in the wellbore liner (FIG. 6*b*).

As noted upper end 120*a* of the liner may be formed to follow the shape of upper limit of the lateral wellbore in which it is to be positioned. The liner upper end 120*a* may be cut at an angle across its long axis such that it has a tapering tip 120*b*. The angle may correspond to the angle at which the lateral kicks off from the main wellbore. In another embodiment, the end may be concavely shaped from side to side to follow the curvature of the main wellbore. Such forming may shape the upper end to be wedge shaped tapering toward tip 120*b*, which will that portion positioned in the very upper limit of the lateral wellbore.

Manipulating the running tool to run the liner into the lateral wellbore includes, in this embodiment, collapsing key to allow the tool to ride through the main wellbore. Manipulating also includes supporting the liner as it is lowered into the main wellbore and pushing the liner into the lateral wellbore until key 122 is close to window 114.

Employing the running tool key to locate the lower V-shaped end of the window acts to ensure that running tool is properly oriented in the lateral wellbore, which in turn ensures that the liner upper end is properly oriented in the junction, for example, with the liner's taper following the taper of the lateral wellbore at its upper end. For example, such that the liner tip 120*b* is positioned in the uphole end of the lateral and the liner and all components thereof are positioned entirely in the lateral wellbore.

In one embodiment, manipulating running the tool into the main wellbore such that a lower portion of the liner is located in the lateral wellbore and the key is at a location close to and uphole from the window, as determined by working string length such as a drill pipe tally; and employing the running tool key includes having the key deployed in an active position and lowering the tool until the key is caught against the window, as determined by rotating the string and monitoring torque and/or by lowering the tool and monitoring string weight.

If it appears, by monitoring depth and string conditions, that the key has passed the window without being caught on it, the string can be picked up to move the key above the window and the string can be rotated such that the key approaches the window from a different angle.

Once the string condition indicates that the key is caught on the window, the string can be rotated and lowered, to see if the tool can be moved down. If the tool cannot move down further, it is indicative that the key has located the bottom V-shaped end 114*a* of the window and, in particular, the key is located in the bottom V-shaped end 114*a* of the window. To move the key down along the edge of the window, it may require the tool to be picked up, rotated, and set down a number of times. Alternately, the key may simply ride along the window, as by application of weight thereabove, to the lowest point which is the bottom V-shaped end 114*a*.

Because the key is rotationally connected to the liner-engaging portion, rotation of the key to the bottom of the window, causes tip 120*b* to be positioned at the upper end of the window.

The placement of the liner is adjacent the window as shown in FIG. 6*b* but without any liner portion protruding from the lateral into the main wellbore. The liner upper end may be spaced less than 10 m and possibly less than 5 m away from the window. In one embodiment, the upper end of the liner will be positioned within one meter of the window, and possibly substantially flush with the window. Stated another way, the upper limit of the lateral liner may be substantially in plane with the main wellbore inner wall through which the window has been formed.

Withdrawing the running tool may include releasing the liner-engaging portion from engagement with the liner and pulling the tool to surface. In so doing, the key moves with the tool to surface. In another embodiment, before releasing the liner from the running tool, liner components may be actuated. For example, in one embodiment, packer 132 is actuated to seal the annular area 130 and slips 134 are actuated to engage in the wellbore wall. Actuating these liner components may include communicating from surface to the liner components, such as, for example, communicating a pressurized fluid to the liner components to actuate them hydraulically. Communicating a pressurized fluid may include passing fluid through the running tool body.

After withdrawing, the liner remains in the lateral wellbore with an open annulus about the liner and the lateral wellbore wall, even about upper end 120*a*. Packer 132 seals against fluid migration up and down through the annulus.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A running tool for placement of a liner in a lateral wellbore that forms a junction with a main wellbore over a window which has a V-shaped downhole end, the running tool comprising:

an articulated body with an uphole end and a downhole end;

a liner-engaging portion provided adjacent to the downhole end of the running tool, adapted to releasably engage the liner; and a key protruding from the running tool just uphole from the liner-engaging portion, the key adapted to catch on the window when the running tool with the liner is lowered in the wellbore, locate and engage the V-shaped downhole end, and orient the liner relative to the window by driving rotation of the liner and the running tool within the lateral wellbore to align the liner relative to the window.

2. The running tool of claim 1, wherein the liner-engaging portion is adapted to secure the liner to the running tool and to controllably disengage the liner from the running tool after the liner upper end is positioned over the window.

3. The running tool of claim 1, wherein the articulated body further includes a central bore for controlling operation of the liner-engaging portion hydraulically.

4. The running tool of claim 1, further comprising a tool engaging portion at the uphole end for engagement with a wellbore work string.

5. The running tool of claim 1, wherein the key includes curved sides to lower the friction interaction with the window edges.

6. The running tool of claim 1, wherein the key is formed using one or more of: the angle of the key with respect to the body, the side-to-side and base-to-tip cross-sectional shape of the key, and the longitudinal cross-sectional shape of the key.

7. The running tool of claim 1, wherein the body includes an articulation uphole from the key, for enabling displacement of the liner though the window.

8. The running tool of claim 1, wherein the liner-engaging portion is designed to enable the liner, when engaged in the liner-engaging portion, to carry one or more packers for fixing the liner in the lateral wellbore.

9. The running tool of claim 1, further comprising a liner position indicator to provide placement, axial positioning and rotational positioning of the liner in the main and lateral wellbore.

10. A system for joining a main wellbore with a lateral wellbore over a window which has a V-shaped downhole end, comprising:

a liner with an uphole end shaped to match the shape of the window; and a running tool adapted to place a liner in the lateral wellbore, including:

an articulated body with an uphole end and a downhole end;

a liner-engaging portion provided adjacent to the downhole end of the running tool, adapted to releasably engage the liner; and a key protruding from the running tool just uphole from the liner-engaging portion, the key adapted to catch on the window when the running tool with the liner is lowered in the wellbore, locate and engage the V-shaped downhole end, and orient the liner relative to the window by driving rotation of both the liner and the running tool within the lateral wellbore to align the liner relative to the window.

11. The system of claim 10, wherein the liner further comprises a swivel provided to enable rotation of a portion of the liner uphole from the swivel to be rotated from surface, while the lower portion of the liner, downhole from the swivel, to be unaffected.

12. The system of claim 10, wherein the uphole end of the liner, when placed over the window and directly adjacent the window does not extend out into the main wellbore.

13. A method of installing a wellbore liner in a lateral wellbore extending from a main wellbore through a window having a V-shaped downhole end beyond which the lateral wellbore extends, the method comprising:

providing the liner with an uphole end shaped to match the shape of the window;

supporting the liner on a running tool, the running tool having a body defined between an uphole end through which the running tool is manipulated from surface, a downhole end and a key protruding from the body;

manipulating the running tool to run the liner into the lateral wellbore;

employing the key to locate and engage the V-shaped downhole end, and to orient the liner relative to the window by driving rotation of both the liner and the running tool within the lateral wellbore to align the liner relative to the window;

setting an installation structure adapted to secure the liner in the lateral wellbore with no portion of the liner and no portion of the installation structure protruding into the main wellbore; and withdrawing the running tool, including the key, from the wellbore.

14. The method of claim 13, wherein supporting the liner on a running tool comprises attaching the liner to a liner-engaging portion provided adjacent to the downhole end of the running tool, the liner-engaging portion being adapted to releasably engage the liner.

15. The method of claim 14, wherein the liner-engaging portion of the running tool is actuated to disengage the liner using hydraulic pressure.

16. The method of claim 13, wherein employing the key to locate the V-shaped downhole end comprises:

catching the key on the window when the running tool with the liner is lowered in the wellbore;

engaging the V-shaped downhole end to align axially and rotationally the liner to the V-shaped downhole end.

17. The method of claim 16, wherein employing the key to locate the V-shaped downhole end further comprising monitoring resistance to movement of the running tool downhole, to determine when the key has engaged the V-shaped downhole end of the window.

18. The method of claim 13, wherein setting installation structure includes setting slips to anchor the liner against a wall of the lateral wellbore.

19. The method of claim 13, wherein manipulating the running tool includes moving the running tool axially and/or rotationally from the surface to catch the key against the window to identify the location of the window.

* * * * *